US006880639B2

(12) United States Patent
Rhodes et al.

(10) Patent No.: US 6,880,639 B2
(45) Date of Patent: Apr. 19, 2005

(54) DOWNHOLE INJECTION SYSTEM

(75) Inventors: R. David Rhodes, Henderson, TX (US); Joe B. Welch, Kilgore, TX (US)

(73) Assignee: RW Capillary Tubing Accessories, L.L.C., Kilgore, TX (US)

( * ) Notice: Subject to any disclaimer, the term of this patent is extended or adjusted under 35 U.S.C. 154(b) by 0 days.

(21) Appl. No.: 10/620,956

(22) Filed: Jul. 16, 2003

(65) Prior Publication Data

US 2004/0040718 A1 Mar. 4, 2004

Related U.S. Application Data

(60) Provisional application No. 60/406,200, filed on Aug. 27, 2002.

(51) Int. Cl.[7] ..... E21B 34/10
(52) U.S. Cl. ..... 166/321; 166/325
(58) Field of Search ..... 166/319, 320, 166/321, 325, 326; 251/176, 337

(56) References Cited

U.S. PATENT DOCUMENTS

| | | | | | |
|---|---|---|---|---|---|
| 2,847,074 | A | * | 8/1958 | Maly et al. | 166/325 |
| 3,087,551 | A | * | 4/1963 | Kerver | 166/317 |
| 3,205,955 | A | * | 9/1965 | Whittle | 175/235 |
| 3,444,886 | A | * | 5/1969 | Bailey et al. | 137/541 |
| 3,455,382 | A | * | 7/1969 | Chenoweth | 166/147 |
| 3,473,611 | A | * | 10/1969 | Gregston | 166/310 |
| 4,063,594 | A | * | 12/1977 | Canterbury | 166/325 |
| 4,087,207 | A | * | 5/1978 | Chappell et al. | 417/54 |
| 4,326,585 | A | * | 4/1982 | McStravick | 166/244.1 |
| 4,393,928 | A | * | 7/1983 | Warnock, Sr. | 166/105 |
| 4,399,871 | A | * | 8/1983 | Adkins et al. | 166/325 |
| 4,424,862 | A | * | 1/1984 | Munari et al. | 166/168 |
| 4,441,558 | A | | 4/1984 | Welch et al. | 166/317 |
| 4,485,876 | A | | 12/1984 | Speller | 166/373 |
| 4,552,218 | A | | 11/1985 | Ross et al. | 166/319 |
| 4,589,495 | A | * | 5/1986 | Langer et al. | 166/383 |
| 4,648,457 | A | | 3/1987 | Ross et al. | 166/334.1 |
| 4,977,927 | A | * | 12/1990 | Hill | 137/539 |
| 5,141,056 | A | | 8/1992 | Tailby | 166/318 |
| 6,622,795 | B1 | * | 9/2003 | Hebert et al. | 166/374 |
| 6,666,273 | B1 | * | 12/2003 | Laurel | 166/382 |
| 2003/0121654 | A1 | * | 7/2003 | Carlin | 166/100 |

* cited by examiner

*Primary Examiner*—David Bagnell
*Assistant Examiner*—Daniel P Stephenson
(74) *Attorney, Agent, or Firm*—Alan R. Thiele; Strasburger & Price, LLP

(57) ABSTRACT

A system for the downhole injection of chemical into a well through capillary tubing using a surface chemical pump includes downhole injection valve. The downhole injection valve includes an upstream and a downstream check valve connected in series. The upstream check valve has an adjustable spring bias. The amount of bias is dependent on the nature of the well and the system for inserting chemical through the capillary tube into the well. The lower check valve has a fixed bias and protects the injection valve from the unwanted backflow of gas, fluids or solids.

18 Claims, 3 Drawing Sheets

DOWNHOLE INJECTION SYSTEM

REFERENCE TO RELATED APPLICATION

This application claims priority from U.S. Provisional Patent Application Ser. No. 60/406,200 filed Aug. 27, 2002.

BACKGROUND OF THE INVENTION

1. Field

The downhole injection system of the present invention is used to inject chemicals such as foaming agents, corrosion inhibitors, and water into wells to treat an observed condition within the well.

2. Background

Wells, particularly those wells which produce hydrocarbons, exhibit various conditions which affect well production or the operability of the equipment inserted into the well. One way of treating such conditions is to inject predetermined amounts of chemical into the well at a downhole location. Such chemical can be pumped from the surface through a capillary tube to a downhole injection valve. Not only is the type of chemical used extremely important, but the injection of a predetermined amount of chemical at a specific rate of application is also critical. If a full column of fluid can be maintained in the capillary tube leading from the chemical pump to the bottom of the well, control of the amount of chemical injected into the well is a relatively simple operation.

However, it has long been recognized by well operators that if the injection pressure or back-pressure exerted on the valve at the bottom of the capillary tubing is not correct, the contents of the capillary tube may actually be siphoned into the well. This siphoning action of the chemical within the capillary tubing is due to the fact that in most systems for injecting chemicals for foaming (for example, in gas wells that are fluid loaded), the hydrostatic pressure at the end of the capillary tubing-is greater than the actual flowing bottom-hole pressure within the well. Therefore, the end of the capillary tubing sees a relative vacuum within the well. This relative, vacuum results in the siphoning of the chemical out of the capillary tube and into the well. This unwanted siphoning of chemical from the capillary tube makes it very difficult to regulate or assure a consistent flow or continuous volume of chemical into the well.

In addition, voids or bubbles in the column of chemical within the capillary tubing will permit well gases and fluids to enter the capillary tubing from the bottom of the well. This movement of gases and fluids into the capillary tubing can result in a plugging of the capillary tubing and/or gas pressure escaping through the capillary tube to the surface. More importantly, the movement of gases and fluids through the capillary tubing caused by voids or bubbles results in an inconsistent application of chemicals such as anti-foaming agents, corrosion inhibitors, etc. The inconsistent application of chemicals adversely affects the application of foamers or corrosion protection of the equipment within the well. In such situations, it has been found that much more chemical must be used than what appears to be actually needed to control a condition within the well. Experience in the chemical treatment of downhole well conditions has shown that a consistent application of chemical provides much greater benefit to the well than an inconsistent or "batch" treatment application of chemical to the bottom of a well.

Prior art valves for the injection of chemicals downhole into a well are described in U.S. Pat. No. 4,441,558 to Welch, et al., U.S. Pat. No. 4,485,876 to Speller; U.S. Pat. No. 4,552,210 to Ross, et al.; U.S. Pat. No. 4,648,457 to Ross, et al.; and U.S. Pat. No. 5,141,056 to Tailby, et al.

Despite the number of chemical injection valves for use downhole within a well which can be found in the prior art, the problem remains to provide a system for inserting a consistent amount of chemical downhole into a well.

SUMMARY

The disclosed downhole injection system provides for inserting a consistent amount of chemical downhole into a well. Specifically included at the end of the capillary tubing extending into the well from the chemical pump are two check valves. The two check valves are in series flow with one another. The upstream or first check valve is adjustably biased to have a cracking pressure which can be pre-set based on: the flowing bottom-hole pressure of the well, the depth of the well, the chemical injected into the well, the pressure imparted on the chemical by the chemical pump, and the size and length of the capillary tubing.

Downstream from the first check valve is a second check valve which prevents the entry of gas, fluids, or solids from the well bore into the interior of the elongated tubular housing of the disclosed downhole valve. This housing both provides for mounting the injection valve to the capillary tubing and positioning the first and second check valves one with respect to the other.

BRIEF DESCRIPTION OF THE DRAWING FIGURES

A better understanding of the present invention may be had by reference to the drawing figures, wherein.

DESCRIPTION OF THE EMBODIMENTS

Figure 1:
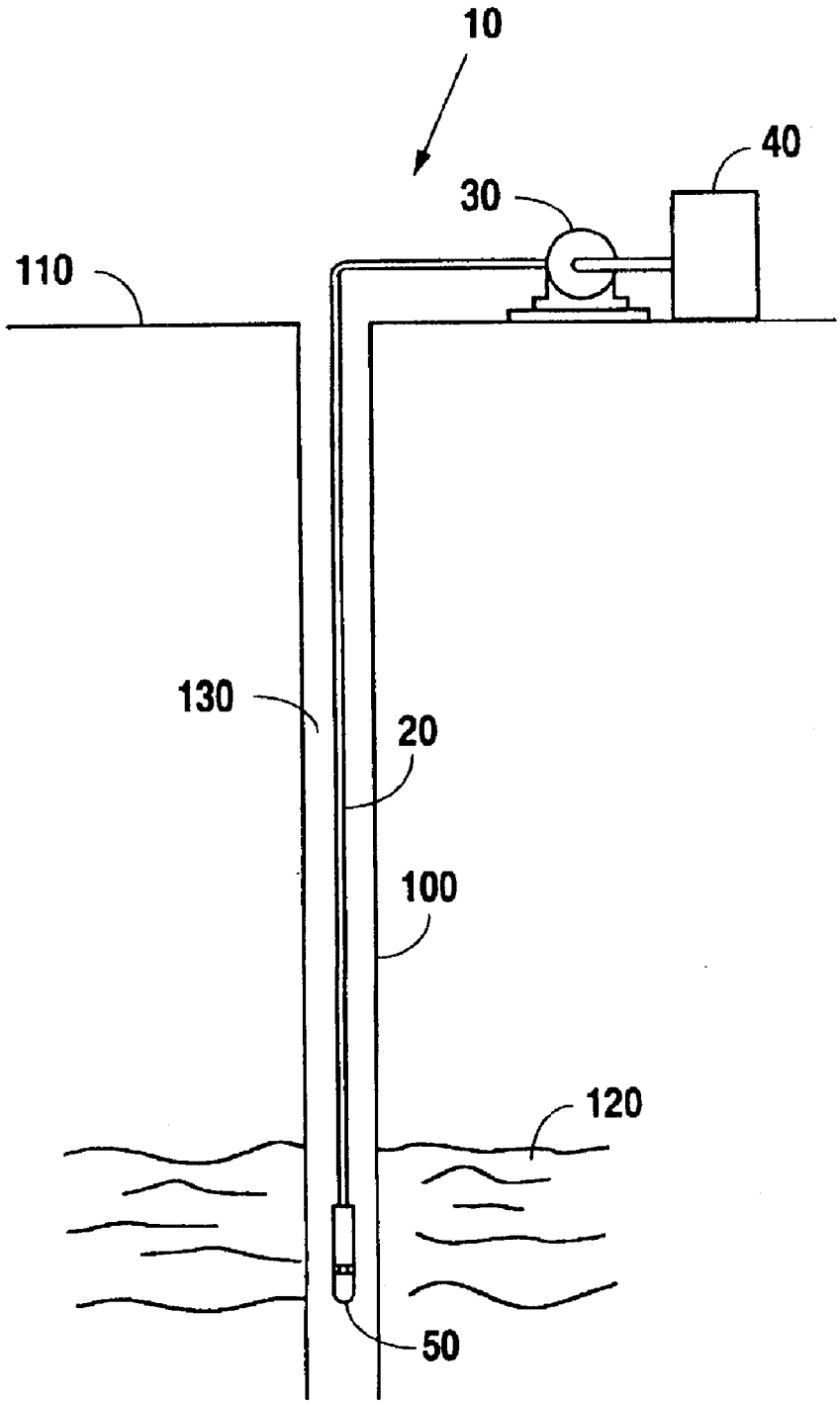
FIG. 1 is a schematic showing the disclosed system for injection chemical into a well.

The disclosed system 10 is shown in FIG. 1. Specifically, a well bore 100 extending from the earth's surface 110 to a subsurface repository 120 of hydrocarbons includes a borehole 130. Within the borehole 130 are typically found various layers of casing and the equipment needed to produce hydrocarbons from the formation 120 located at various locations within the well 100 or at the bottom of the well 100. Those in the business of producing hydrocarbons from wells 100 understand that each well 100 will have its own unique characteristics. The characteristics or the conditions found at the bottom of a well 100 will affect the ability of the well 100 to produce hydrocarbons or affect the operability of the equipment located at the bottom of the well 100. To minimize the effect of such conditions, it has been found that if a predetermined amount of chemical is maintained at the bottom of a well, the troubling conditions may be reduced. For example, if liquid loading is a problem, a predetermined amount of a foaming agent inserted into the Well 100 will minimize the liquid loading problem. Similarly, if there is a particularly corrosive environment at the bottom of a well 100, it is possible to maintain a level of anti-corrosion chemicals at the bottom of the well 100 to minimize the corrosive effect of the condition of the well 100 on the equipment within the well 100.

It is most effective to treat the condition within a well 100 by inserting a predetermined amount of the proper chemical at a location within the well 100 closest to which the condition occurs. The insertion of chemical at the location where the condition occurs is accomplished by extending a length of capillary tubing 20 from the surface 110 through the; borehole 130 into the desired location within the well 100. The preselected chemical is then pumped by a chemical pump 30 from a reservoir 40 through the capillary tubing 20 to the location within the well 100. Controlling the flow of the chemical within the well 100 is an injection valve assembly 50 located at the bottom of the capillary tubing 20. If this injection valve assembly 50 does not function properly, an improper amount of chemical will be inserted into the well 100, and the condition at the bottom of the well 100 will not be remedied. Alternatively, if the injection valve assembly 50 does not operate properly, it may be necessary to pump excessive amounts of chemical into the well 100 to insure that the proper amount of chemical is maintained in the well 100 to treat the condition which is affecting either well production or the equipment within the well 100.

Figure 2:
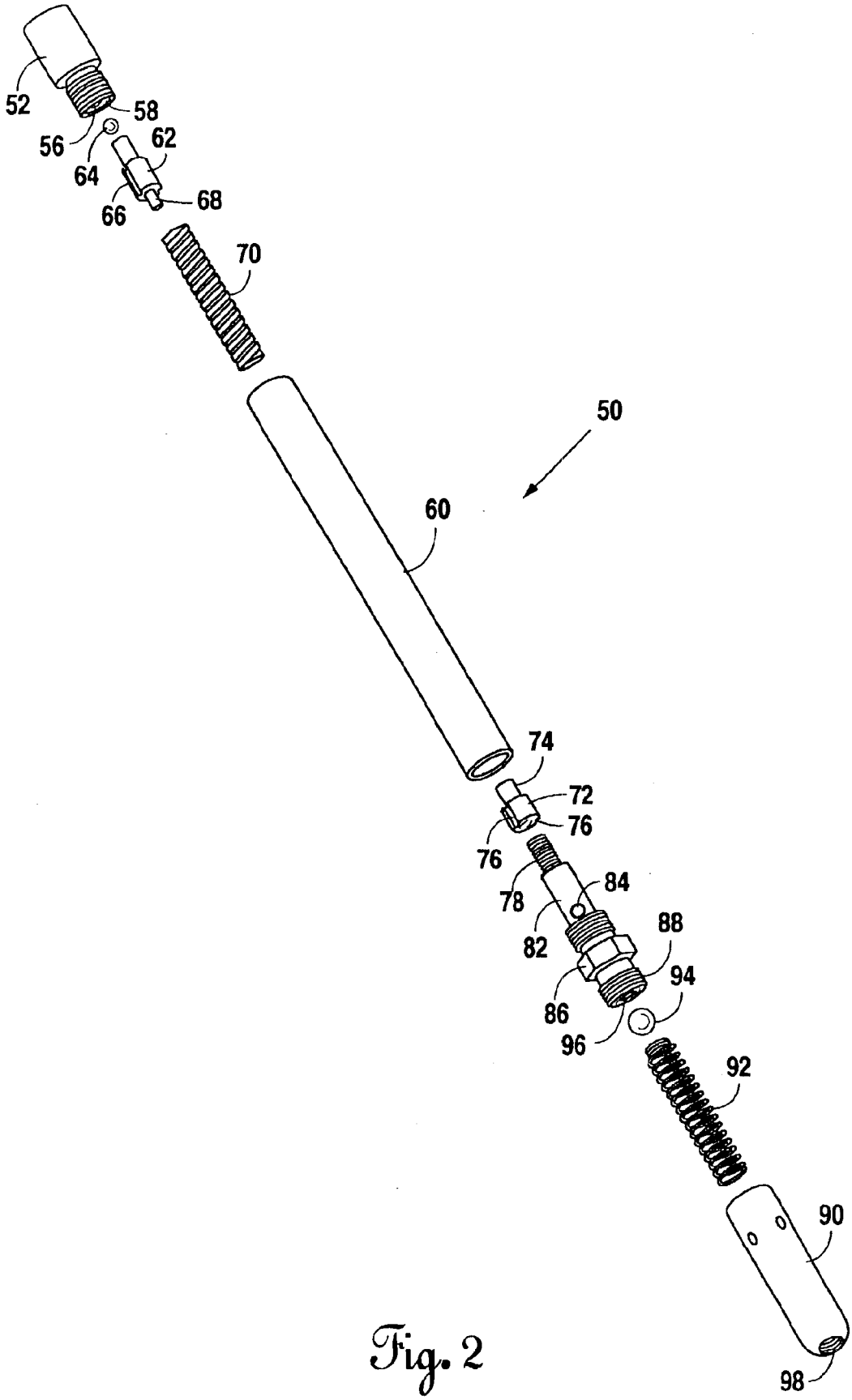
FIG. 2 is an exploded view of the injection valve.
Figure 3:
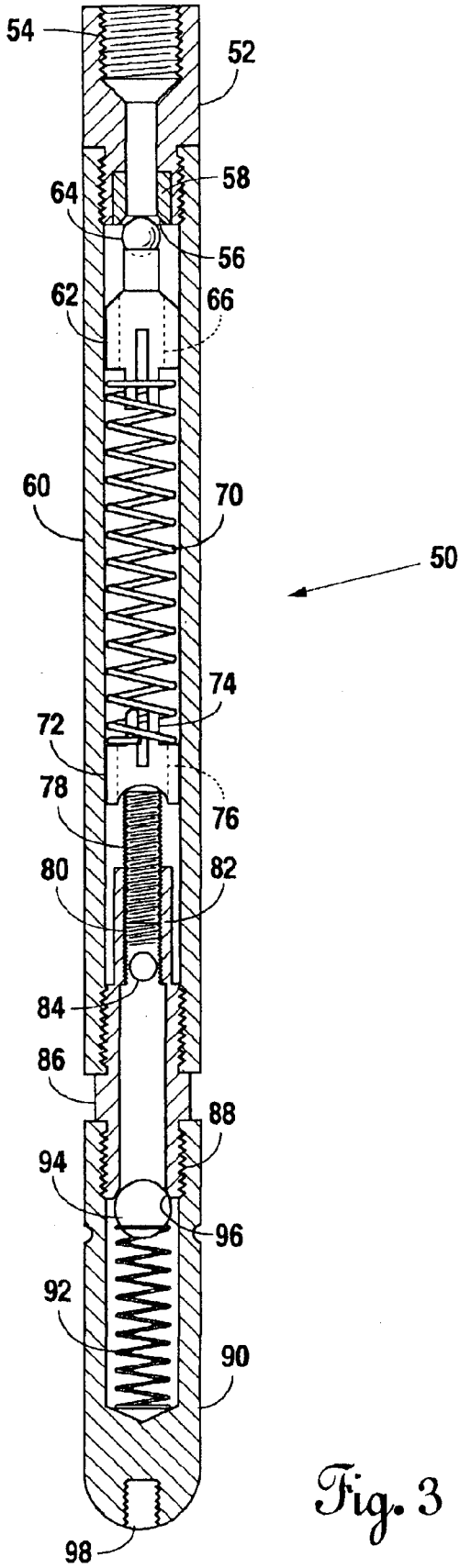
FIG. 3 is an assembly view in partial section of the injection valve.

To remedy the problem of assuring that the proper amount of chemical is maintained at the bottom of the well 100, the injection valve assembly 50 of the present invention is attached to the bottom of the capillary tubing 20 which is run down into the well 100 from the chemical pump 30. As may be seen in FIGS. 2 and 3, the disclosed injection valve assembly 50 is assembled from a variety of parts which provide both for mounting the injection valve assembly 50 at the end of the capillary tubing and mounting two check valves in a series flow arrangement.

At the upper or upstream end of the injection valve assembly 50 is located a hollow top connector 52. Within the hollow top connector 52 are internal threads 54 for attachment to the bottom end of the capillary tubing 20. The top connector 52 is hollow and at its downstream end terminates in a tapered valve seat 56. In the preferred embodiment, a carbide insert 58 is used to reduce wear on the tapered valve seat 56 within the top connector 52.

Threadably attached to the top connector is a tube body 60. At the upstream end of the tube body is an upper, spring carrier 62. Permanently attached to the top of the upper spring carrier 62 is a carbide ball 64 which, when resting against the seat 56 at the bottom of the top connector 52, blocks the flow of fluid through the top connector 52' and the injection valve assembly 50. At the bottom of the upper spring carrier 62 are flow-through slots 66 which provide a passage for the flow of chemical when the ball 64 is positioned away from the seat 56 at the bottom of the top connector 52.

Engaging an extension 68 on the lower end of the upper spring carrier 62 is a main spring 70. The connection of the main spring 70 to the extension 68 on the bottom of the upper spring carrier 62 provides a mechanical bias of the ball 64 to the seat 56 at the bottom of the top connector 62. In the preferred embodiment, this mechanical bias is provided by a coil spring 70; however, other means of providing a mechanical bias well known to those of ordinary skill in the art may be used. At the downstream end of the coil spring 70 is a bottom spring carrier 72. An extension 74 on the top of the bottom spring carrier 74 engages spring 70. As will be understood by those of ordinary skill in the art, the distance between the bottom spring carrier 72 and the upper spring carrier 62 determines the amount of compression of the main spring 70. The amount of compression of the main spring 70 is what determines the amount of bias force on the first or upstream check valve assembly 55 located where the carbide ball 64 is in close proximity to the seat 56 at the bottom of the top connector 52.

Mechanically positioning the bottom spring carrier 72 within the tube body 60 are two threaded rods 78, 80. The upper, threaded rod 78 contacts the underside of the bottom spring carrier 72. This upper threaded rod 78 is held in position by a lower threaded rod 80. Both the upper threaded rod 78 and the lower threaded rod 80 threadably engage an adjustable housing 82. This adjustable housing 82 includes a flow-through port 84 which allows chemical passing through the flow-through slots 66 in the upper spring carrier 62, thence through the flow-through slots 76 in the bottom spring carrier 72, to pass through the adjustable housing 82. The adjustable housing 82 is threadably connected to the lower end of the tube body 60. Wrench flats 86 are provided on the adjustable housing 60 so that it may be tightened when connected to the lower end of the tube body 60. Those of ordinary skill in the art will then understand that once the adjustable housing 82 has been threaded into the tube body 60, it is the length of the upper threaded piece 78 and the lower threaded piece 80 and their position within the adjustable housing 82 which determines the position of the bottom spring carrier 72 within the tube body 60. As previously mentioned, it is the distance between the bottom spring carrier 72 and the upper spring carrier 62 which determines the force provided by the mainspring 70 on the upstream check valve. The greater the force of the spring on the upstream check valve assembly 50, the greater the amount of fluid force that will be required to move the ball 64 away from the seat 56 and permit the flow of chemical through the capillary tubing 20 and through the injection valve assembly 50.

Attached to the threads 88 on the bottom end of the adjustable housing 82 is an end cover 90. Positioned within the end cover is a trash check spring 92. Located on top of the trash check spring 92 is a carbide ball 94. This carbide ball is sized to engage a seat 96 which is formed at the bottom of the adjustable housing 82. The ball 94 and seat 96 combination within the end cover 90 provides a second check valve assembly 85 in series fluid flow with the first check valve assembly 55. This second check valve assembly 85 located at the bottom of the injector valve 50 prevents the entry of gas, fluids, or solids from the well bore 130 into the interior portion of the elongated tubular housing 60, and thus serves to protect the operation of the injection valve assembly 50.

For convenience, a threaded opening 98 is provided at the bottom of the end cover 90 so that additional equipment may be attached to the bottom of the injection valve assembly 50.

Accordingly, the disclosed injection valve will allow a Chemical to pass through the elongated tubular housing 60 while holding a pre-set working pressure. A properly pre-set injection valve working pressure will assure that the capillary tube 20 above the injection, valve 50 is kept full of chemical while providing a positive pressure against the discharge pressure of the chemical pump 30.

EXAMPLE ONE 110,000 ft. Capillary tubing depth

Foamer Injection application (8.327 ppg foamer)

350 psi Flowing Bottom-Hole pressure 400 psi desired chemical pump pressure

Injection valve set pressure 4380 psi

The ball check valve assembly on the bottom of the injection valve assembly described in Example One acts as a protection against well bore solids entering the interior portion of the injection valve, particularly during the placement of the injector valve assembly into the well or when the flow of chemical through the injection valve assembly is temporarily halted. In the preferred embodiment, the cracking pressure to open the ball check valve on the bottom of the injection valve assembly is about 50 psi.

The standard service injection valve assembly is made of 316 stainless steel, 17-4 stainless internal parts, and with a tungsten carbide seat and trim. An extreme service injection valve assembly may be made with Inconel® stainless steel or any other corrosion resistant high strength metal.

While the present system and method has been disclosed according to the preferred embodiment of the invention, those of ordinary skill in the art will understand that other embodiments have also been enabled. Such other embodiments shall fall within the scope and meaning of the appended claims.

What is claimed is:

1. A downhole injection valve assembly for controlling the downhole insertion of chemical into a well through capillary tubing, said downhole injection valve assembly comprising:

an elongated tubular housing including an inlet end and an outlet end;

said elongated tubular housing including means for attachment to the capillary tubing at said inlet end;

a first check valve having an adjustable mechanical bias, said first valve being positioned within said elongated tubular housing at said inlet end, said adjustable mechanical bias on said first check valve being determined by the position of a movable rod within said elongated tubular housing;

a second check valve having a fixed mechanical basis positioned within said elongated tubular housing at said outlet end to prevent the entry of gas, fluids or solids from said well bore into the interior portion of said elongated tubular housing;

an outlet port positioned between said first and second check valves.

2. The downhole injection valve assembly as defined in claim 1 wherein said adjustable mechanical bias is set according to the characteristics of the well including the depth of the well, and the flowing bottom-hole pressure at the bottom of the well.

3. The downhole injection valve assembly as defined in claim 2 wherein said adjustable mechanical bias is set according to the characteristics of said system for causing the chemical to flow through the capillary tubing into the well including at least chemical pump pressure, capillary tubing size, and capillary tubing length.

4. The downhole injection valve assembly as defined in claim 1 wherein said adjustable mechanical bias is provided by a coil spring.

5. The downhole injection valve assembly as defined in claim 4 wherein said adjustable mechanical bias is determined by the compression of said coil spring provided by said movable rod.

6. The downhole injection valve assembly as defined in claim 5 wherein position of said movable rod is determined by the threaded engagement of said movable rod with a spring carrier positioned within said elongated tubular housing.

7. The downhole injection valve assembly as defined in claim 1 wherein said fixed mechanical bias on said second check valve is provided by a coil spring.

8. The downhole injection valve assembly as defined in claim 1 wherein said first check valve is a ball and seat valve.

9. The downhole injection valve assembly as defined in claim 8 wherein said seat is formed from a hardened material.

10. A system for the control of a condition at the downhole portion of a well, said system comprising:

a chemical selected for its ability to control the condition at the downhole portion of a well;

a capillary tube for conducting said chemical from the surface to the downhole portion of the well;

a chemical pump for causing said chemical to flow through said capillary tube;

an injection valve assembly including:

an elongated tubular housing including an inlet end and an outlet end;

said elongated tubular housing including means for attachment to the capillary tubing at said inlet end;

a first check valve having an adjustable mechanical bias, said first valve being positioned within said elongated tubular housing at said inlet end, said adjustable mechanical bias on said first check valve being determined by the position of a movable rod within said elongated tubular housing;

a second check valve having a fixed mechanical bias positioned within said elongated tubular housing at said outlet end to prevent the entry of gas, fluids or solids from said well bore into the interior position of said elongated tubular housing;

an outlet port positioned between said first and second check valves.

11. The system as defined in claim 10 wherein said adjustable mechanical bias is set according to the characteristics of the well including the depth of the well, and the flowing hole pressure at the bottom of the well.

12. The system as defined in claim 11 wherein said adjustable mechanical bias is set according to the characteristics of said system for causing the chemical to flow through the capillary tubing into the well including chemical pump pressure.

13. The system as defined in claim 10 wherein said adjustable mechanical bias is provided by a coil spring.

14. The system as defined in claim 13 wherein said adjustable mechanical bias is determined by compression of said coil spring provided by said movable rod.

15. The system as defined in claim 14 wherein the position of said movable rod is determined by the threaded engagement of said movable rod with a spring carrier positioned within said elongated tubular housing.

16. The system as defined in claim 10 wherein said fixed mechanical bias on said second check valve is provided by a coil spring.

17. The system as defined in claim 10 wherein said first check valve is a ball and seat valve.

18. The system as defined in claim 17 wherein said seat is formed from a hardened material.

* * * * *